United States Patent [19]

Oohashi

[11] Patent Number: 4,516,559

[45] Date of Patent: May 14, 1985

[54] IGNITION COIL DEVICE FOR INTERNAL COMBUSTION ENGINE

[75] Inventor: Yutaka Oohashi, Himeji, Japan

[73] Assignee: Mitsubishi Denki Kabushiki Kaisha, Japan

[21] Appl. No.: 507,569

[22] Filed: Jun. 24, 1983

[30] Foreign Application Priority Data

Jun. 30, 1982 [JP] Japan ..... 57-115066

[51] Int. Cl.[3] ..... F02P 3/02

[52] U.S. Cl. ..... 123/634; 336/83; 336/212; 336/229

[58] Field of Search ..... 123/634, 635; 336/83, 336/96, 212, 229

[56] References Cited

U.S. PATENT DOCUMENTS

| | | | |
|---|---|---|---|
| 2,948,871 | 8/1960 | Craige | 336/83 |
| 3,175,176 | 3/1965 | Henschke | 336/96 X |
| 3,236,937 | 2/1966 | Harkness et al. | 336/96 X |
| 3,609,613 | 9/1971 | Horn et al. | 336/83 |
| 3,888,225 | 6/1975 | Boyer et al. | 123/196.5 A X |

FOREIGN PATENT DOCUMENTS 56-104162 8/1981 Japan .

*Primary Examiner*—Tony M. Argenbright

*Attorney, Agent, or Firm*—Leydig, Voit, Osann Mayer and Holt, Ltd.

[57] ABSTRACT

According to this invention, an ignition coil device is assembled so that a rotary shaft of a distributor or the like may penetrate therethrough in a direction parallel to the main magnetic fluxes produced by coils therein, wherein, a coil assembly in which a primary coil and a secondary coil are unitarily molded by an insulating molding material is formed in a doughnut-shape, and the whole periphery of the coil assembly is covered with a core is centrally provided with a through hole for inserting said rotary shaft therethrough.

1 Claim, 6 Drawing Figures

IGNITION COIL DEVICE FOR INTERNAL COMBUSTION ENGINE

BACKGROUND OF THE INVENTION

This invention relates to improvements in an ignition coil device for the spark ignitor of an internal combustion engine.

A prior-art device of the specified type has been as shown in FIGS. 1 and 2. Referring to the figures, numeral 1 designates a coil assembly in which a primary coil and a secondary coil are wound in a manner to be insulated from each other and are covered with a molding material. A core 2 forms a magnetic path which is common to the primary coil and the secondary coil wound in the coil assembly 1. Numeral 3 indicates a terminal which is connected to one end of the primary coil, numeral 4 a terminal which is connected to the other end of the primary coil and one end of the secondary coil in common, and numeral 5 a high-voltage terminal which is connected to the other end of the secondary coil. The terminal 3, the terminal 4 and the high-voltage terminal 5 are respectively fastened integrally with the coil assembly 1 by a molding material.

FIG. 3 shows an equivalent circuit of the prior-art device. Here, symbol 1*a* denotes the primary coil, and symbol 1*b* the secondary coil. In addition, FIG. 4 is an electric circuit diagram showing the state of connection during the use of the prior-art device. Referring to FIG. 4, a battery 6 supplies current to the primary coil 1*a* of the ignition coil. An interrupter 7 interrupts the current through the primary coil 1*a* according to the ignition timing of the engine. An ignition plug 8 sparks upon receiving a high voltage which is generated across the secondary coil 1*b* of the ignition coil.

In operation, when the interrupter 7 interrupts the current flowing through the primary coil 1*a* at a predetermined time after the conduction thereof therethrough, a high voltage is induced in the secondary coil 1*b* and is supplied to the ignition plug 8 through the high-voltage terminal 5.

The prior-art ignition coil device is constructed and operated as described above. Therefore, when it is combined with another device such as a distributor having a rotary shaft, a housing for supporting the shaft, etc., it must be arranged so as to avoid the rotary shaft, the housing etc. This has led to the disadvantage that the whole structure is not balanced and that space is wasted.

SUMMARY OF THE INVENTION

According to this invention, an ignition coil device for an internal combustion engine having a primary coil, a secondary coil and a core for forming a magnetic path common to the coils is characterized in that the core and a coil assembly covering the coils are formed with inserting holes so as to permit another member to penetrate through the inner parts of the respective coils and the core in a direction parallel to the main magnetic fluxes of the coils, thereby to facilitate the combination of the ignition coil device with another device having a rotary shaft, a housing for supporting the rotary shaft, etc. and to reduce the size of the whole structure.

BRIEF DESCRIPTION OF THE DRAWINGS

In the drawings, the same symbols indicate the same or corresponding parts.

DESCRIPTION OF THE PREFERRED EMBODIMENT

Figure 1:
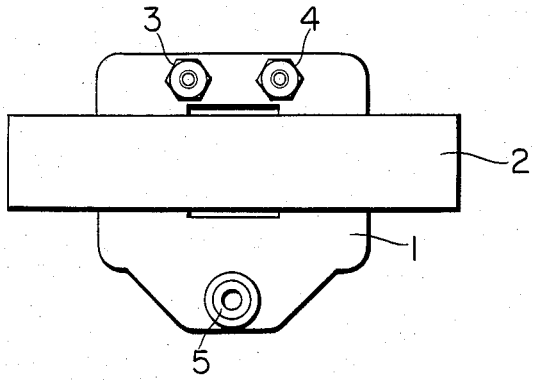
FIG. 1 PRIOR ART
FIGS. 1 and 2 are a plan view and a sectional side view showing a prior-art ignition coil device, respectively.
Figure 2:
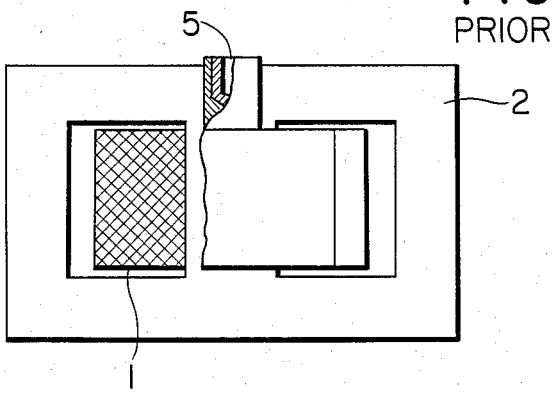
FIG. 2 PRIOR ART
Figure 3:
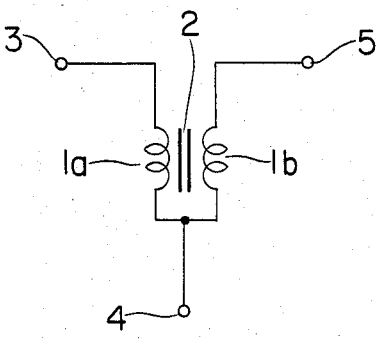
FIG. 3 is an equivalent electric circuit diagram of a general ignition coil.
Figure 4:
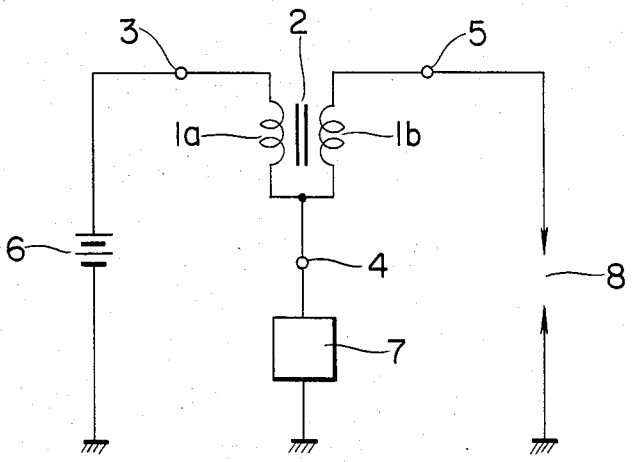
FIG. 4 is an electric circuit diagram of a general ignition device for an internal combustion engine.
Figure 5:
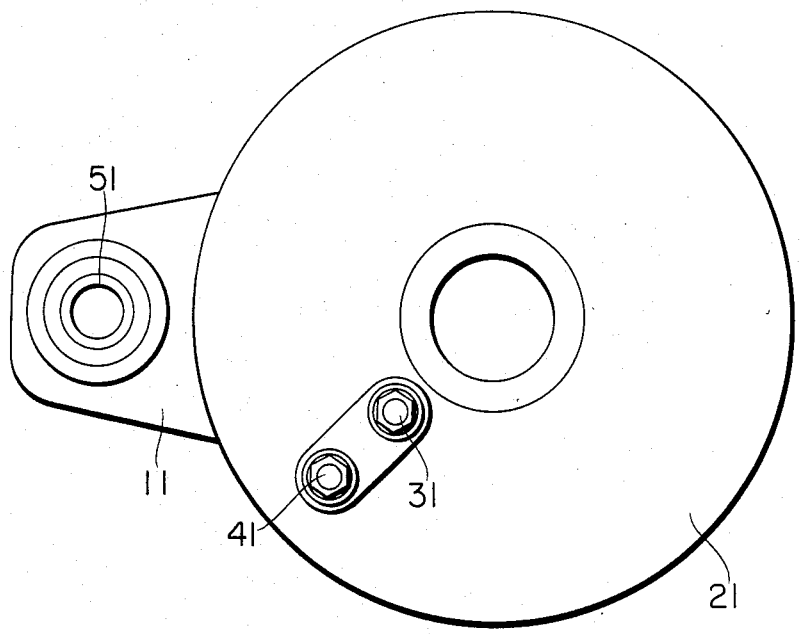
FIGS. 5 and 6 are a plan view and a sectional side view showing an ignition coil device according to an embodiment of the present invention, respectively.
Figure 6:
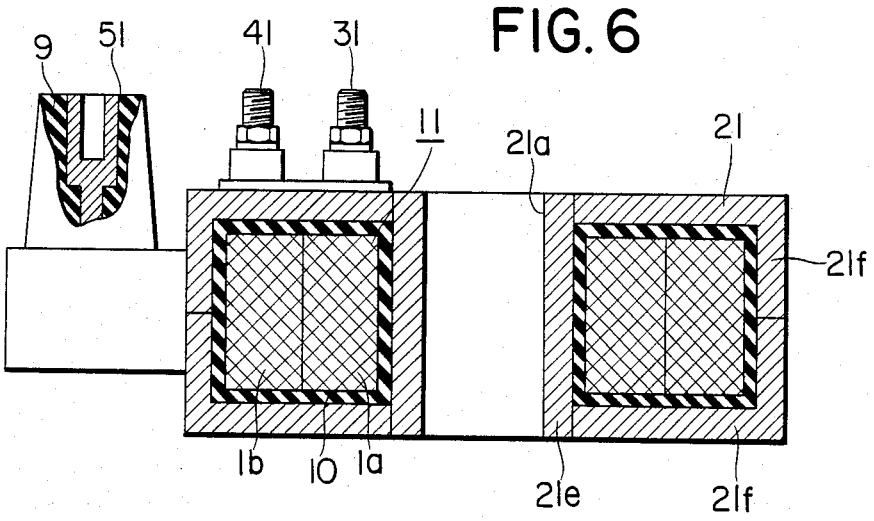

An embodiment of this invention will be described with reference to FIGS. 5 and 6. FIGS. 5 and 6 show one embodiment of the present invention. Referring to the figures, numeral 11 designates a coil assembly in which a primary coil 1*a* and a secondary coil 1*b* wound in a manner to be insulated from each other are covered with a molding material having an insulating property, such as polypropylene, and which is formed in the shape of a toroid. A core 21 which is split into a plurality of parts, forms a magnetic path common to the primary coil and secondary coil wound in the coil assembly 11, and has an inserting hole 21*a* formed therein so that a member to be inserted (not shown) such as the rotary shaft of an ignition distributor can penetrate therethrough. Numeral 31 designates a terminal which is connected to one end of the primary coil 1*a*, numeral 41 a terminal which is connected to the other end of the primary coil 1*a* and one end of the secondary coil 1*b* in common, and numeral 51 a high-voltage terminal which is connected to the other end of the secondary coil 1*b*. The primary coil terminal 31, the common terminal 41 and the high-voltage terminal 51 are fastened integrally to the coil assembly 11 by a molding material 9 such as polypropyrene. Shown at numeral 10 is a resin coil bobbin and for providing insulation.

Changes in magnetic fluxes caused by the interruption of current through the primary coil 1*a* induces a high voltage in the secondary coil 1*b* in the core 21. In the present invention, besides the above function as the ignition coil, the ignition coil device has the function that the member to be inserted such as the rotary shaft can penetrate inside the coils in a direction parallel to the main magnetic fluxes of the coils. The penetrating member to be inserted may constitute the magnetic path of the primary coil in the present invention.

In the embodiment, the core 21 has been illustrated as being split into a plurality of parts, and consists of a first core member 21*e* which is annular and which is centrally located and two second core members 21*f* which cover the outer peripheral surfaces of the coils. The first and second core members together form the shape of a toroid. However, it may comprise any toroidal shape adapted to form a magnetic path.

As set forth above, according to this invention, an ignition coil device is so constructed that a desired member to be inserted therethrough can penetrate inside an ignition coil. Therefore, combination of the ignition coil device with another device is facilitated, and the whole structure can be balanced and reduced in size.

Especially in the case of assembling the ignition coil device in an ignition distributor, the former can be arranged around the rotary shaft of the latter. This brings forth the merit that any special receiving portion need not be provided in the distributor for the installation of the ignition coil device.

What is claimed is:

1. An ignition coil device for an internal combustion engine comprising:

a core which includes a first annular core member having a central axis and a second core member;

said second core member being connected to said first core member so as to define a toroidal coil space outside said first core member and being split along a plane transverse to said axis to divide said second core member into separate parts, each having an axially extending cylindrical section and a radically extending annular section;

a toroidal coil assembly which is arranged in said toroidal coil space; and said toroidal coil assembly having a primary coil and a secondary coil for generating a high voltage for the ignition of the engine and being arranged so as to surround said first core member and so as to be surrounded by said separate parts of said second core member when assembled with the cylindrical sections thereof in contact with each other and the annular sections in contact along the inner periphery with said annular core member.

* * * * *